US008834113B2

(12) United States Patent
Schaus et al.

(10) Patent No.: US 8,834,113 B2
(45) Date of Patent: Sep. 16, 2014

(54) ALIGNMENT MEMBER FOR STEAM TURBINE NOZZLE ASSEMBLY

(75) Inventors: Carl Joseph Schaus, Charlton, NY (US); Steven Sebastian Burdgick, Schenectady, NY (US); Dominick Joseph Werther, Albany, NY (US)

(73) Assignee: General Electric Company, Schenectady, NY (US)

( * ) Notice: Subject to any disclaimer, the term of this patent is extended or adjusted under 35 U.S.C. 154(b) by 519 days.

(21) Appl. No.: 13/185,813

(22) Filed: Jul. 19, 2011

(65) Prior Publication Data

US 2013/0022453 A1 Jan. 24, 2013

(51) Int. Cl.
*F01D 25/24* (2006.01)
*F01D 9/04* (2006.01)

(52) U.S. Cl.
CPC ..... *F01D 25/246* (2013.01); *F05D 2230/644* (2013.01); *F01D 9/041* (2013.01); *F05D 2220/31* (2013.01)
USPC ..... 415/209.2

(58) Field of Classification Search
USPC ..... 415/126, 129, 209.2, 213.1, 173.2, 415/174.1; 416/204, 205, 207, 219, 244
See application file for complete search history.

(56) References Cited

U.S. PATENT DOCUMENTS

| | | | | |
|---|---|---|---|---|
| 1,352,278 | A * | 9/1920 | Junggren | 415/135 |
| 1,873,743 | A * | 8/1932 | Doran | 415/136 |
| 2,247,387 | A * | 7/1941 | Johnson et al. | 415/209.2 |
| 2,247,423 | A * | 7/1941 | Webster, Jr. | 415/209.2 |
| 3,498,727 | A * | 3/1970 | Bollinger, Jr. et al. | 415/136 |
| 3,861,827 | A * | 1/1975 | Peabody et al. | 415/209.2 |
| 4,204,803 | A * | 5/1980 | Leger et al. | 415/209.2 |
| 5,709,388 | A * | 1/1998 | Skinner et al. | 277/412 |
| 6,244,819 | B1 * | 6/2001 | Voorhees | 415/213.1 |
| 6,325,596 | B1 * | 12/2001 | Tomko | 415/209.2 |
| 6,352,405 | B1 * | 3/2002 | Tomko | 415/209.2 |
| 6,547,523 | B2 * | 4/2003 | Nelligan | 415/209.2 |
| 6,651,986 | B2 * | 11/2003 | Chevrette et al. | 277/421 |
| 6,695,316 | B2 * | 2/2004 | Popa et al. | 277/411 |
| 7,329,098 | B2 | 2/2008 | Burdgick et al. | |
| 7,419,355 | B2 * | 9/2008 | Burdgick | 415/213.1 |
| 7,458,770 | B2 * | 12/2008 | Russo et al. | 415/126 |
| 7,722,314 | B2 * | 5/2010 | Burdgick | 415/108 |
| 7,887,291 | B2 * | 2/2011 | Chevrette et al. | 415/209.2 |
| 8,414,258 | B2 * | 4/2013 | Burdgick et al. | 415/209.2 |
| 8,430,625 | B2 * | 4/2013 | Golinkin et al. | 415/126 |
| 8,528,181 | B2 * | 9/2013 | Maurell et al. | 29/434 |
| 8,529,198 | B2 * | 9/2013 | Burdgick | 415/126 |
| 2003/0049123 | A1 * | 3/2003 | Nelligan | 415/209.2 |
| 2006/0251514 | A1 * | 11/2006 | Burdgick | 415/214.1 |
| 2007/0189893 | A1 * | 8/2007 | Burdgick | 415/213.1 |
| 2008/0286097 | A1 * | 11/2008 | Chevrette et al. | 415/209.2 |

(Continued)

*Primary Examiner* — Edward Look
*Assistant Examiner* — Eldon Brockman
(74) *Attorney, Agent, or Firm* — Hoffman Warnick LLC; Ernest G. Cusick

(57) ABSTRACT

An alignment member for a turbine diaphragm segment is disclosed. The alignment member is configured to span radially across a portion of the turbine diaphragm segment and an adjacent turbine casing segment. The alignment member can include: a main body having a first aperture for aligning with a first corresponding aperture in one of the turbine diaphragm segment or the turbine casing segment; and a flange extending from the main body, the flange including a second aperture for aligning with a portion of the other of the turbine diaphragm segment or the turbine casing segment, the alignment member for adjusting a position of the turbine diaphragm segment relative to the adjacent turbine casing segment.

20 Claims, 7 Drawing Sheets

(56) References Cited

U.S. PATENT DOCUMENTS

2008/0317591 A1* 12/2008 Golinkin et al. ..... 415/213.1
2011/0116919 A1* 5/2011 Burdgick et al. ..... 415/209.2
2011/0250063 A1* 10/2011 Burdgick et al. ..... 415/209.2
2011/0305566 A1* 12/2011 Sankolli et al. ..... 415/209.2
2012/0114470 A1* 5/2012 Burdgick ..... 415/201
2012/0121391 A1* 5/2012 Burdgick et al. ..... 415/148

* cited by examiner

ALIGNMENT MEMBER FOR STEAM TURBINE NOZZLE ASSEMBLY

BACKGROUND OF THE INVENTION

The subject matter disclosed herein relates to a steam turbine nozzle assembly, or diaphragm stage. Specifically, the subject matter disclosed herein relates to an alignment system for a steam turbine nozzle assembly.

Steam turbines include static nozzle assemblies that direct flow of a working fluid into turbine buckets connected to a rotatable rotor. The nozzle construction (including a plurality of nozzles, or "airfoils") is sometimes referred to as a "diaphragm" or "nozzle assembly stage." Steam turbine diaphragms include two halves, which are assembled around the rotor, creating horizontal joints between these two halves. Each turbine diaphragm stage is vertically supported by support bars, support lugs or support screws on each side of the diaphragm at the respective horizontal joints. The horizontal joints of the diaphragm also correspond to horizontal joints of the turbine casing, which surrounds the steam turbine diaphragm.

Conventionally, the nozzle assembly stages are aligned either with the rotor in place, or without the rotor, using a hard wire or laser measurement. In one conventional approach, the lower half of the nozzle assembly stage (or, nozzle lower half) and the rotor are aligned without the upper half of the nozzle assembly stage (or, nozzle upper half) and/or the upper half of the turbine casing in place. In this approach, measurements are made between the lower half and the rotor at the bottom and each respective side of the turbine. In a second conventional approach, the nozzle upper half and casing upper half (as well as the respective lower halves) are in place without the rotor. In this approach, measurements are made between the bearing centerline locations and the nozzle assembly centerline.

In either case, conventional approaches to alignment/adjustment of steam path components requires separately measuring the relative position of components, disassembling portions of the components, and adjusting shims used to fine-tune the position of these components. Subsequent to the adjustment of the shims, the components are reassembled, and measurement is conducted yet again. This process may be iterated a number of times until the measurements fall within a predetermined acceptable range. The iterative nature of this process can be both time consuming and costly.

BRIEF DESCRIPTION OF THE INVENTION

An alignment member for a turbine diaphragm segment is disclosed. The alignment member is configured to span radially across a portion of the turbine diaphragm segment and an adjacent turbine casing segment. The alignment member can include: a main body having a first aperture for aligning with a first corresponding aperture in one of the turbine diaphragm segment or the turbine casing segment; and a flange extending from the main body, the flange including a second aperture for aligning with a portion of the other of the turbine diaphragm segment or the turbine casing segment, the alignment member for adjusting a position of the turbine diaphragm segment relative to the adjacent turbine casing segment.

A first aspect of the invention includes an alignment member for a turbine diaphragm segment. The alignment member is configured to span radially across a portion of the turbine diaphragm segment and an adjacent turbine casing segment. The alignment member can include: a main body having a first aperture for aligning with a first corresponding aperture in one of the turbine diaphragm segment or the turbine casing segment; and a flange extending from the main body, the flange including a second aperture for aligning with a portion of the other of the turbine diaphragm segment or the turbine casing segment, the alignment member for adjusting a position of the turbine diaphragm segment relative to the adjacent turbine casing segment.

A second aspect of the invention includes an alignment apparatus for a turbine diaphragm segment, the alignment apparatus having: an alignment member configured to span radially across a portion of the turbine diaphragm segment and an adjacent turbine casing segment, the alignment member including: a main body having a first aperture for aligning with a first corresponding aperture in the turbine diaphragm segment; and a flange extending from the main body, the flange including a second aperture for aligning with a portion of the turbine casing segment, the alignment member for adjusting a position of the turbine diaphragm segment relative to the adjacent turbine casing segment A third aspect of the invention includes an alignment apparatus for a turbine diaphragm segment, the alignment apparatus having: an alignment lever member configured to span radially between the turbine diaphragm segment and a turbine casing segment, the alignment lever member operably affixed to a portion of the turbine casing segment and including: a main body; and a flange extending radially inward from the main body, the flange for engaging a portion of an upper diaphragm segment, the alignment lever member for modifying a position of the turbine diaphragm segment relative to the turbine casing segment.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
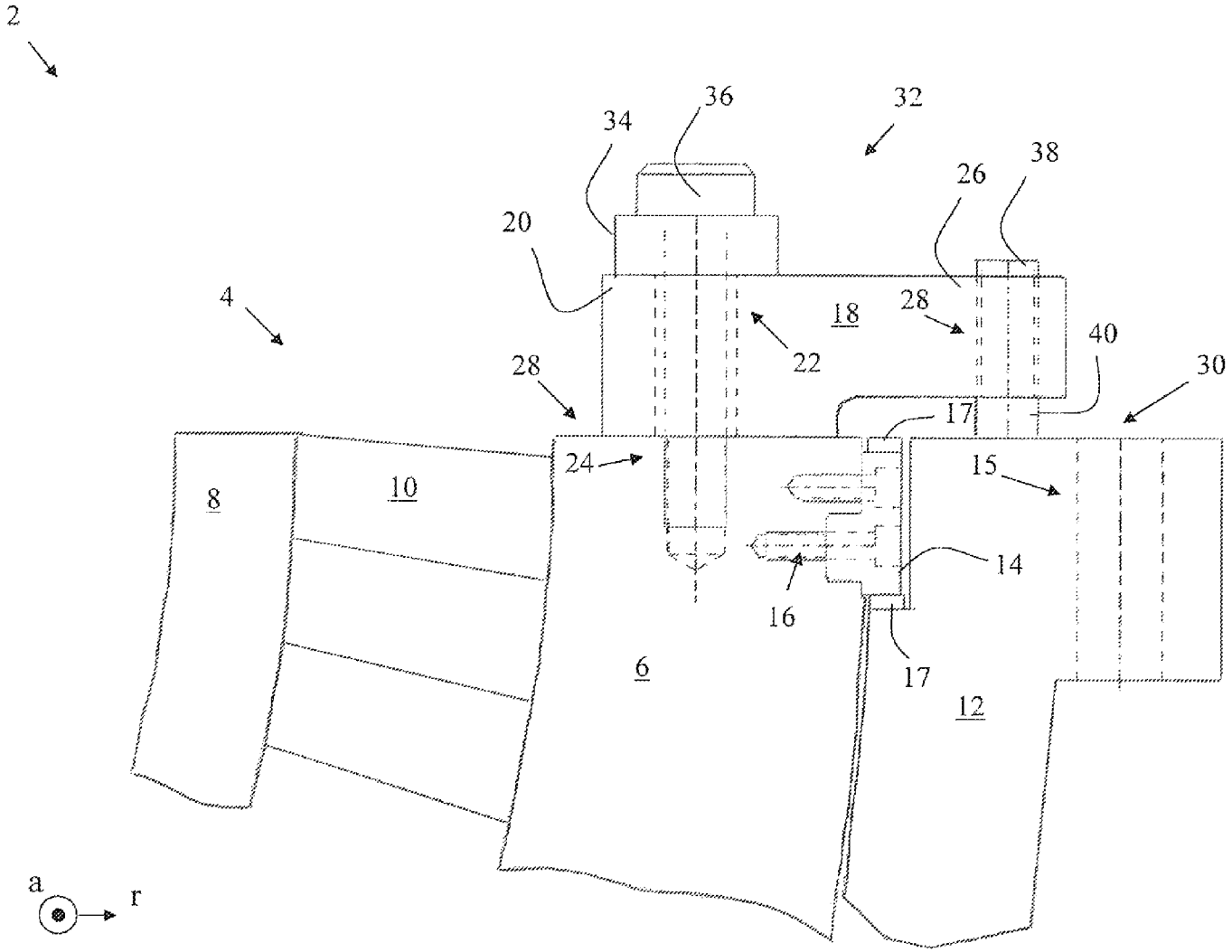
FIG. 1 shows a schematic cut-away view of a steam turbine nozzle assembly including an alignment member according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the invention provide for an alignment system for a steam turbine nozzle assembly. In some embodiments, aspects of the invention provide for an alignment member configured to allow for simultaneous adjustment and measurement of the relative position of steam path components.

Conventionally, the nozzle assembly stages are aligned either with the rotor in place, or without the rotor, using a hard wire or laser measurement. In one conventional approach, the lower half of the nozzle assembly stage (or, nozzle lower half) and the rotor are aligned without the upper half of the nozzle assembly stage (or, nozzle upper half) and/or the upper half of the turbine casing in place. In this approach, measurements are made between the lower half and the rotor at the bottom and each respective side of the turbine. In a second conventional approach, the nozzle upper half and casing upper half (as well as the respective lower haves) are in place without the rotor. In this approach, measurements are made between the bearing centerline locations and the nozzle assembly centerline.

In either case, conventional approaches to alignment/adjustment of steam path components requires separately measuring the relative position of components, disassembling portions of the components, and adjusting shims used to fine-tune the position of these components. Subsequent to the adjustment of the shims, the components are reassembled, and measurement is conducted yet again. This process may be iterated a number of times until the measurements fall within a predetermined acceptable range. The iterative nature of this process can be both time consuming and costly.

In contrast to conventional approaches, aspects of the invention provide for a steam turbine alignment system that allows for simultaneous measurement and adjustment of the position of steam path components, allowing for a reduction in the time required to align these components. Aspects of the invention allow for adjustment of the relative position of steam path components using either older-style support bars (underlying the horizontal joint) or the more modern overhanging support bar. As is known in the art, these support bars are coupled with one or more shims used to align the support bars in one or more slots. Conventionally, these shims are machined to allow for modification of the position of the support bar in the slots. Aspects of the invention described herein provide an approach for determining whether and to what extent the shims should be modified (machined) in order to allow for proper alignment of steam path components.

In one embodiment, an alignment member for a turbine diaphragm segment is disclosed. The alignment member is configured to span radially across a portion of the turbine diaphragm segment and an adjacent turbine casing segment. The alignment member can include: a main body having a first aperture configured to align with a first corresponding aperture in one of the turbine diaphragm segment or the turbine casing segment; and a flange extending from the main body, the flange including a second aperture configured to align with a portion of the other of the turbine diaphragm segment or the turbine casing segment. The alignment member can be configured for adjusting a position of the turbine diaphragm segment relative to the adjacent turbine casing segment. It is understood that the alignment member may be used in conjunction with other elements described herein in an alignment apparatus, or system.

In another embodiment, an alignment apparatus for a turbine diaphragm segment, is disclosed. The alignment apparatus can include an alignment lever member configured to span radially between the turbine diaphragm segment and a turbine casing segment. The alignment lever member can be operably affixed to a portion of the turbine casing segment and include: a main body; and a flange extending radially inward from the main body. The flange can be configured to engage a portion of an upper diaphragm segment. In operation, the alignment lever member can be configured to modify a position of the turbine diaphragm segment relative to the turbine casing segment.

Turning to FIG. 1, a schematic cut-away view of a steam turbine nozzle assembly (or, assembly) 2 is shown according to embodiments of the invention. As shown, the assembly 2 can include a turbine diaphragm segment 4 (e.g., a lower diaphragm segment) having an outer ring 6, an inner ring 8, and a set of nozzles 10 disposed therebetween, as is known in the art. Also shown included in the assembly 2 is a casing segment 12 (e.g., a lower casing segment) at least partially surrounding the outer ring 6, as is known in the art. One type of conventional support bar 14 is shown affixed to the outer ring 6 via conventional bolts 16 (shown in phantom). The support bar 14 is paired with shims 17, which can be used to support the support bar 14 (e.g., as below) and/or an upper casing segment (not shown). The shims 17 are conventionally machined to allow for modification of the position of the support bar 14 in a slot in the casing segment 12 (or outer ring 6).

In contrast to conventional systems, aspects of the invention further include an alignment member 18 for adjusting a position of the diaphragm segment 4 relative to the adjacent casing segment 12. As shown, the alignment member 18 is configured to span radially (indicated by arrow "r" in key on lower-left corner) across a portion of the diaphragm segment 4 (e.g., the outer ring 6) and the adjacent casing segment 12. The alignment member 18 can include a main body 20 having a first aperture 22 configured to align with a first corresponding aperture 24 in the outer ring 6 (or, in an alternative embodiment, in the turbine casing segment 12). The alignment member 18 can also include a flange 26 extending from the main body, the flange 26 including a second aperture 28 configured to align with a portion of the turbine casing segment 12 (or, in an alternative embodiment, an aperture in the turbine casing segment 12). The alignment member 18 is configured to adjust a position of the turbine diaphragm segment 4 (at outer ring 6) relative to the adjacent turbine casing segment 12. In some cases, the main body 20 is configured to align flush with an upper surface (or, horizontal joint surface) 28 of the outer ring 6 (as shown) or an upper surface (or, horizontal joint surface) 30 of the casing segment 12. In some cases, the main body 20 is configured to align flush (without more than nominal space between) with an area of the outer ring 6 (or, casing segment 12) proximate the first aperture 24. It is understood that in alternative embodiments described further herein, the orientation of the alignment member 18 can be altered such that the main body 20 is located over the casing segment 12, and the flange 26 extends over the outer ring 6.

In any case, further shown in FIG. 1 are portions of an adjustment apparatus 32 including the adjustment member 18. The adjustment apparatus 32 can further include a first vertical alignment member 34 and a retaining member 36. The first vertical alignment member 34 can include a variable bolt block in some embodiments, where the retaining member 36 is a bolt (e.g., a partially threaded bolt). On the flange 26 side of the adjustment member 18, a second vertical alignment member 38 is shown engaged with the second aperture 28. In some cases, the second vertical alignment member 38 can include an adjustment screw having a head (e.g., a brass head) 40. The apertures 22 and/or 28 of the adjustment member 18 can be threaded in some embodiments to engage correspondingly threaded screws or bolts.

In one embodiment, the second vertical alignment member 38 is adjustable by rotating or otherwise manipulating the vertical alignment member 38 vertically upward or downward. This allows the head 40 to apply a force against the upper surface 30 of the casing segment 12, thereby adjusting a position of that upper surface 30 relative to the upper surface 28 of the outer ring 6 (which is fixedly attached to the adjustment member 18 via the retaining member 36). In some embodiments, the second vertical alignment member 38 can be adjusted by a hand-held device for use by a human operator.

Figure 2:
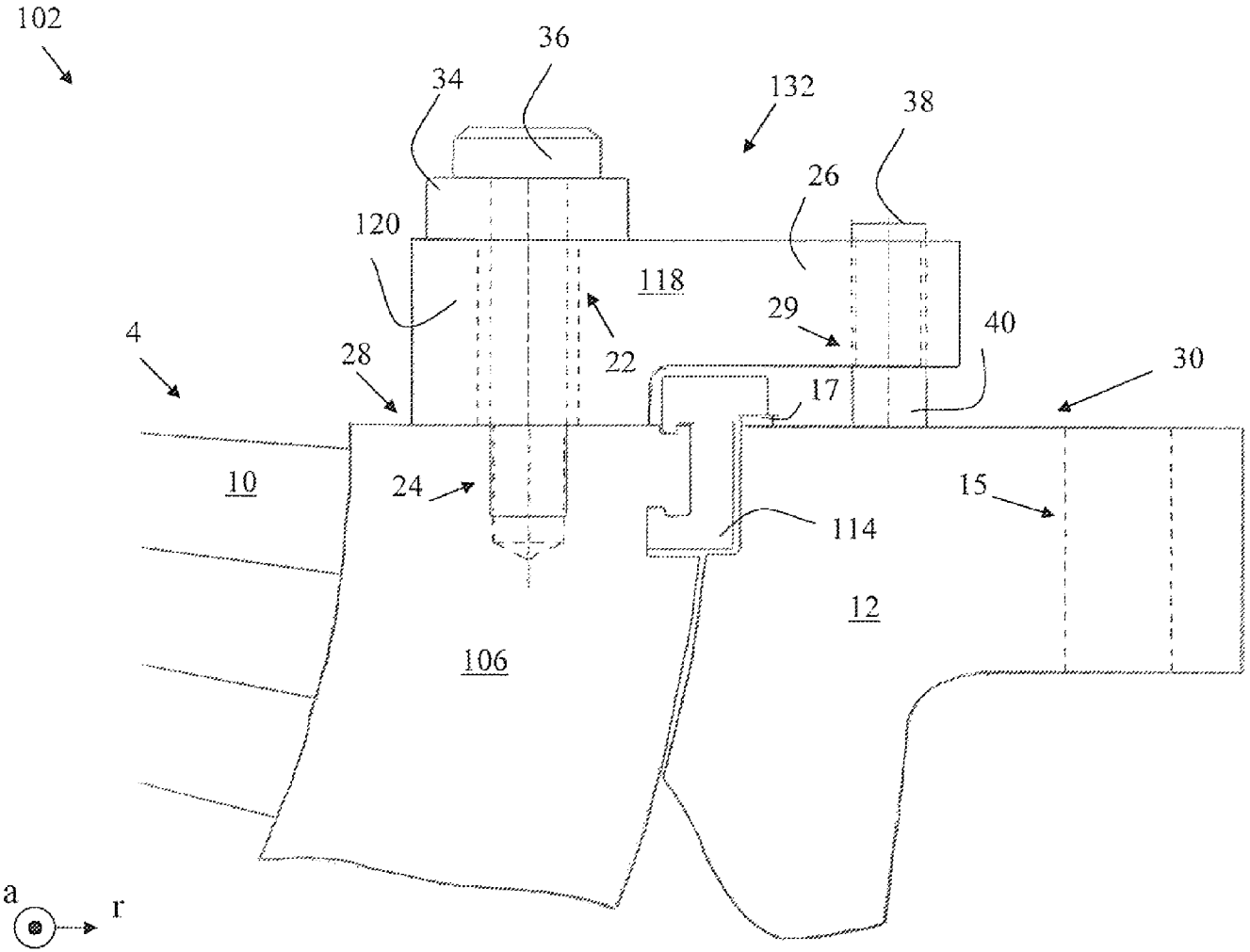
FIG. 2 shows a schematic cut-away view of a steam turbine nozzle assembly including an alignment member according to embodiments of the invention.

FIG. 2 shows a schematic cut-away view of a steam turbine nozzle assembly (or, assembly) 102 according to another embodiment of the invention. It is understood that similarly numbered elements between the figures herein may indicate substantially similar elements. As such, redundant description of these elements is omitted for the purposes of clarity. Returning to FIG. 2, this embodiment includes a substantially similar diaphragm segment 4 and casing segment 12 as shown and described with respect to FIG. 1, however, the embodiment shown and described with respect to FIG. 2 includes an overhanging support bar 114, which includes at least one section for engaging the upper surface of an outer ring 106 and/or the casing segment 12. In order to accommodate the overhanging support bar 114, an adjustment member 118 includes an extended main body 120 portion (extended farther from the upper surface 28) as compared with the main body 20 shown and described with reference to FIG. 1. As in the embodiment shown and described with reference to FIG. 1, alignment may be performed via manipulation of the adjustment member 38.

Figure 3:
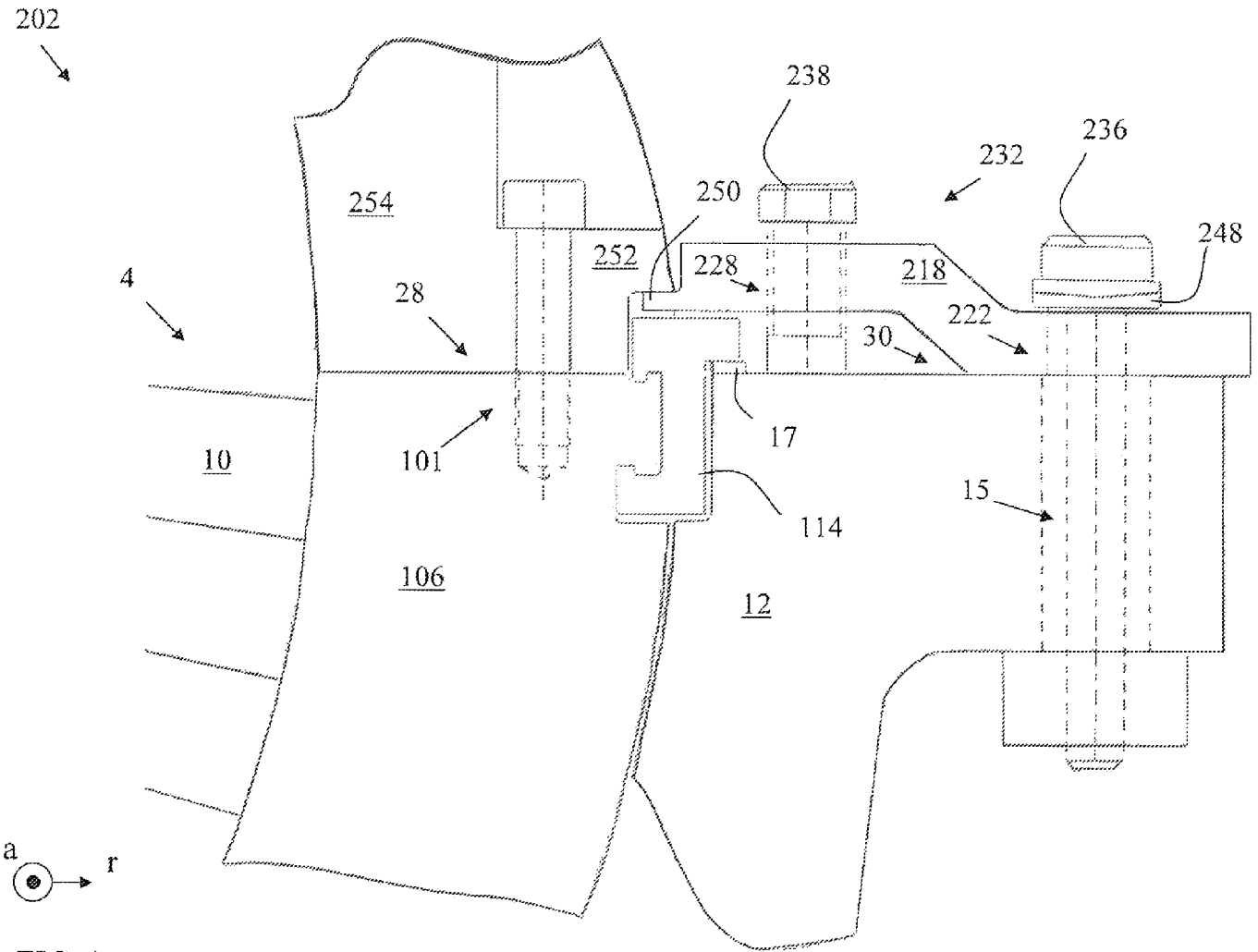
FIG. 3 shows a schematic cut-away view of a steam turbine nozzle assembly including an alignment member according to embodiments of the invention.

FIG. 3 shows a cut-away view of a steam turbine nozzle assembly (or, assembly) 202 according to another embodiment of the invention. In this embodiment, an alignment apparatus 232 is shown including an alignment lever member 218 configured to span radially between the turbine diaphragm segment 4 (e.g., outer ring 6) and the casing segment 12. The alignment lever member 218 is operably affixed to a portion of the casing segment 12 via a fastening member 236. In this case, the alignment lever member 218 can include an aperture 222 for receiving the fastening member 236. In some embodiments, the fastening member 236 can include a bolt (e.g., a gapped, hold-down bolt). Additionally shown is an optional washer member 248, which may be a conventional washer used as an interface between the surface of the fastening member 236 and the alignment lever member 218. In some embodiments, the fastening member 236 is designed to lock the alignment lever member 218 against the upper surface of the casing segment 12. In these cases, the alignment lever member 218 can be designed to adjust the position of the surface 30 of the casing segment 12 relative to the upper surface 28 of the outer ring 6 using an adjustment member 238 extending through a second aperture 228 in the alignment lever member 218. In some cases, the adjustment member 238 includes an adjustment screw having conventional threads that are complemented by threads in the second aperture 228. The adjustment member 238 can contact the upper surface 30 of the casing segment 12, and can effect movement of the alignment lever member 218 via manipulating the position of the adjustment member 238 (e.g., turning the adjustment screw). Generally speaking, the portions of the alignment lever member 218 in contact with the adjustment member 238 and the fastening member 236 are referred to as a "main body" of the adjustment member 238. Extending radially inward from the main body of the alignment lever member 218 is a flange 250 for engaging a portion 252 of an upper diaphragm segment 254. This portion 252 of the upper diaphragm segment 254 can vertically overhang the flange 250 and a portion of the support bar 114. In practice, actuating movement of the adjustment member 238 (vertically upward or downward) causes movement of the alignment member 218, and more specifically, the flange 250. As in some embodiments the flange 250 is substantially free (or, unaffixed to another surface), the flange 250 can either be moved away from the surface 30 of the casing segment 12, or toward the surface 30 of the casing segment 12. Movement of the flange 250 effectuates movement of the portion 252 of the upper diaphragm segment 254 (via physical contact force). As the upper diaphragm segment 254 and outer ring 106 are fastened together (via thru-bolt 101), movement of the upper diaphragm segment 254 allows for adjustment/modification of the position of the casing segment 12 relative to the outer ring 106 (and their respective upper surfaces).

Figure 4:
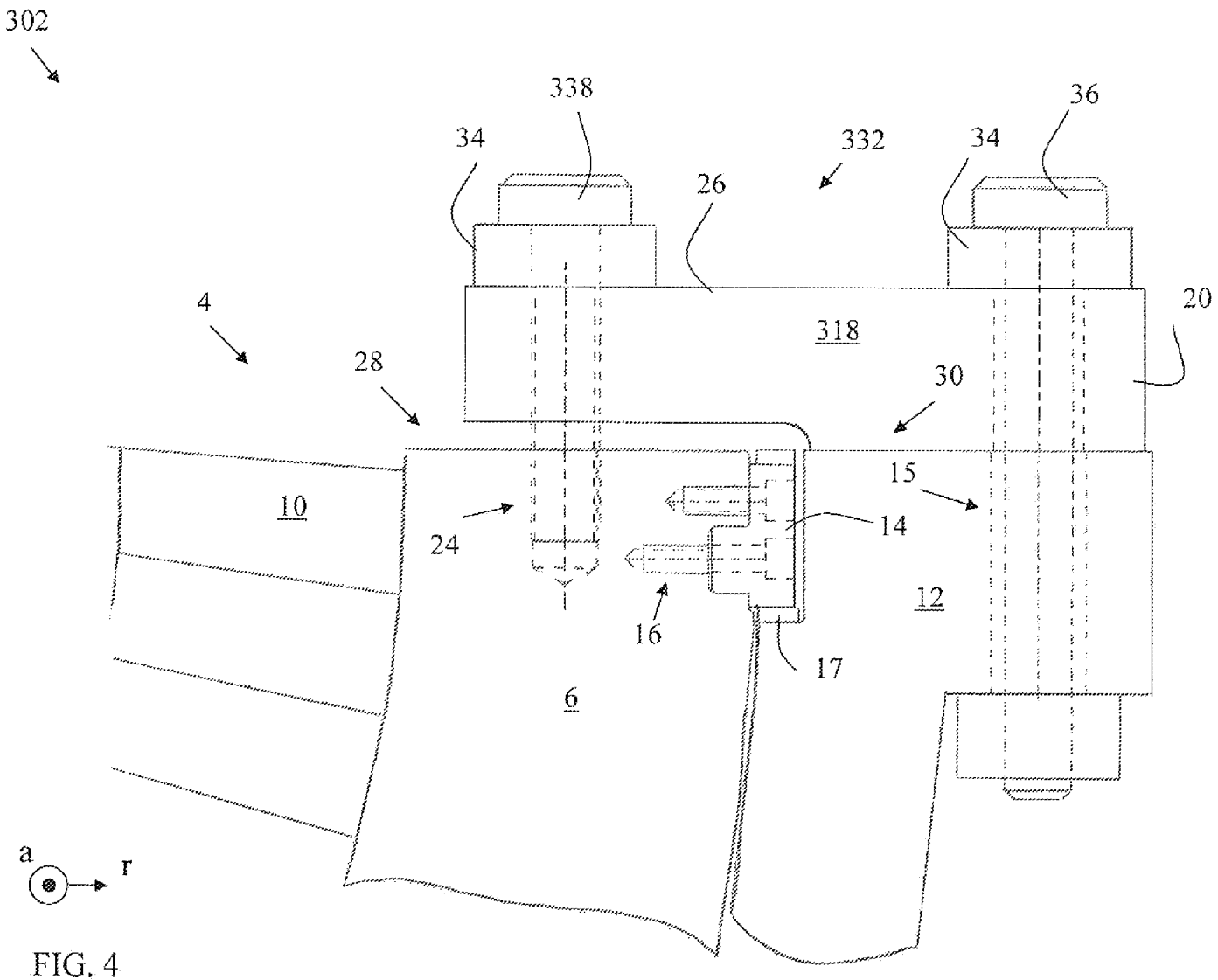
FIG. 4 shows a schematic cut-away view of a steam turbine nozzle assembly including an alignment member according to embodiments of the invention.

FIG. 4 shows a schematic cut-away view of a steam turbine nozzle assembly (or, assembly) 302 according to another embodiment of the invention. This embodiment includes a substantially similar diaphragm segment 4, casing segment 12 and support bar 14 as shown and described with respect to FIG. 1. Similarly, the assembly 302 includes an alignment member 318 spanning radially across the surfaces 28, 30 of the outer ring 6 and the casing segment 12. However, in contrast to the embodiment of FIG. 1, the alignment member 318 has a flange 26 extending over the surface 28 of the outer ring 6, spaced from that surface 28 by a portion of a length of a vertical adjustment member 338. In some cases, where the vertical adjustment member 338 is a screw, the alignment member 318 can be spaced from that surface 28 by the pitch of one or more threads of the adjustment member 338. The adjustment member 338 can be configured to adjust a position of the surface 28 of the outer ring 6 relative to the alignment member 318, and thus, the upper surface 30 of the casing segment 12 (which is fixedly attached to the alignment member 318 via retaining member 36). As is understood in the art, the adjustment member 338 can include any conventional threaded screw or adjustment mechanism for adjusting a vertical position of the outer ring 6 relative to the casing segment 12.

Figure 5:
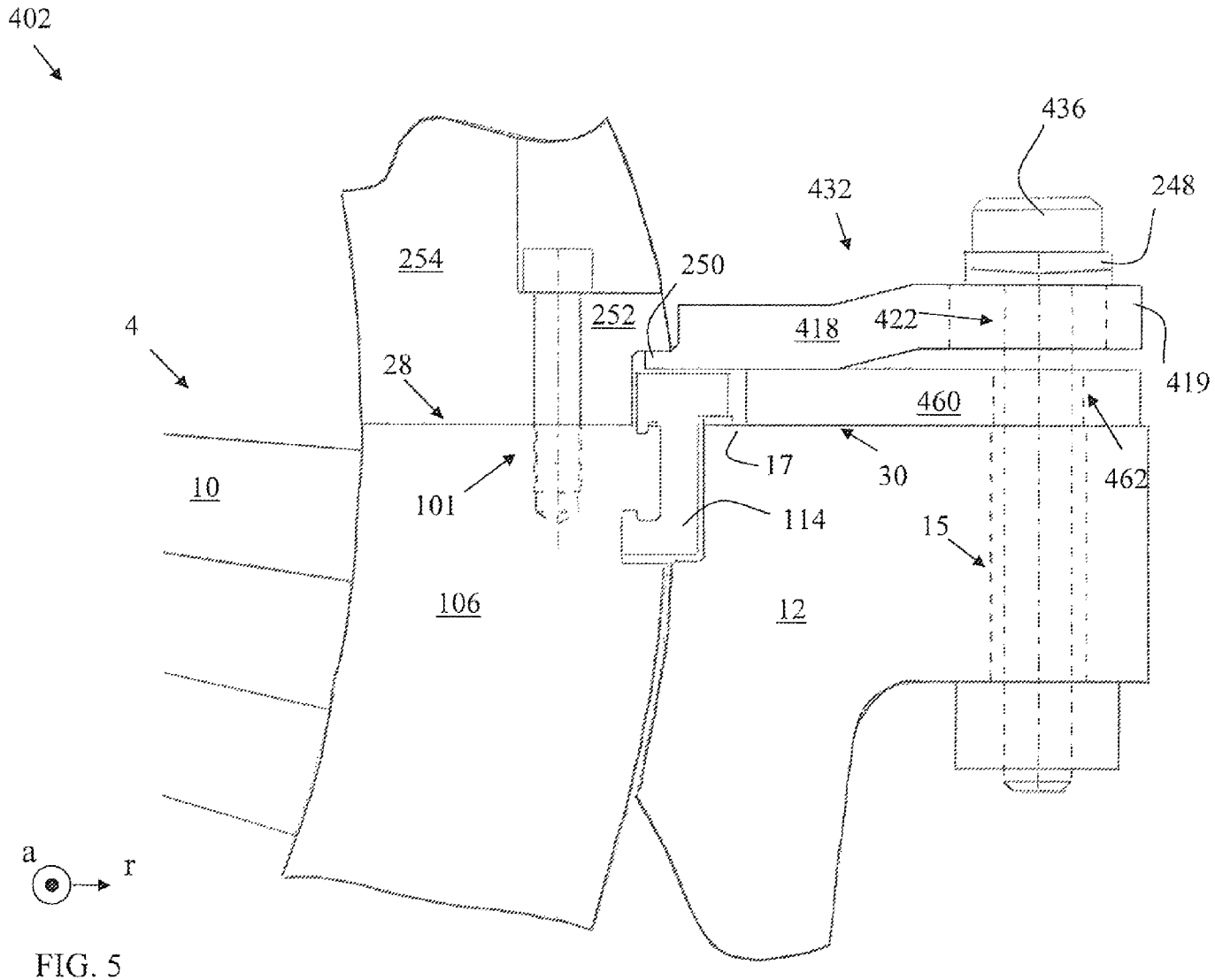
FIG. 5 shows a schematic cut-away view of a steam turbine nozzle assembly including an alignment member according to embodiments of the invention.

FIG. 5 shows a cut-away view of a steam turbine nozzle assembly (or, assembly) 402 according to another embodiment of the invention. In this embodiment, an alignment apparatus 432 is shown including an alignment lever member 418 configured to span radially between the turbine diaphragm segment 4 (e.g., outer ring 6) and the casing segment 12. This embodiment is a variation on the embodiment shown and described with reference to FIG. 3, which also includes an alignment lever member (alignment lever member 218). As shown, the alignment lever member 418 can include a main body and a flange 250 extending from the main body. The alignment lever member 418 can include a stepped segment 419 having an aperture 422 extending therethrough. The aperture 422 can be configured to align with a corresponding aperture 15 in the casing segment 12. Additionally, in this embodiment, the alignment apparatus 432 can include an alignment support block 460 located between the alignment lever member 418 and the upper surface 30 of the casing segment 12. The alignment support block 460 can include an aperture 462 corresponding to the aperture 422 in the alignment lever member 418 and the aperture 15 in the casing segment 12. These apertures (15, 422, 462) can be configured to receive an adjustment screw 436 (paired with a washer 248), where actuation of the adjustment screw adjusts a distance between the stepped segment 419 and the alignment support block 460. This adjustment causes the alignment lever member 418 to pivot about its contact point with the alignment support block 460, causing the end of alignment lever member 418 having the flange 250 to push upward on the upper diaphragm segment 254 at the overhanging portion 252. Because the upper diaphragm segment 254 and lower diaphragm segment 106 are joined by thru-bolt 101, they move in unison, thereby changing the position of the upper surface 28 of the lower diaphragm segment 4 relative to the upper surface 30 of the casing segment 12.

Figure 6:
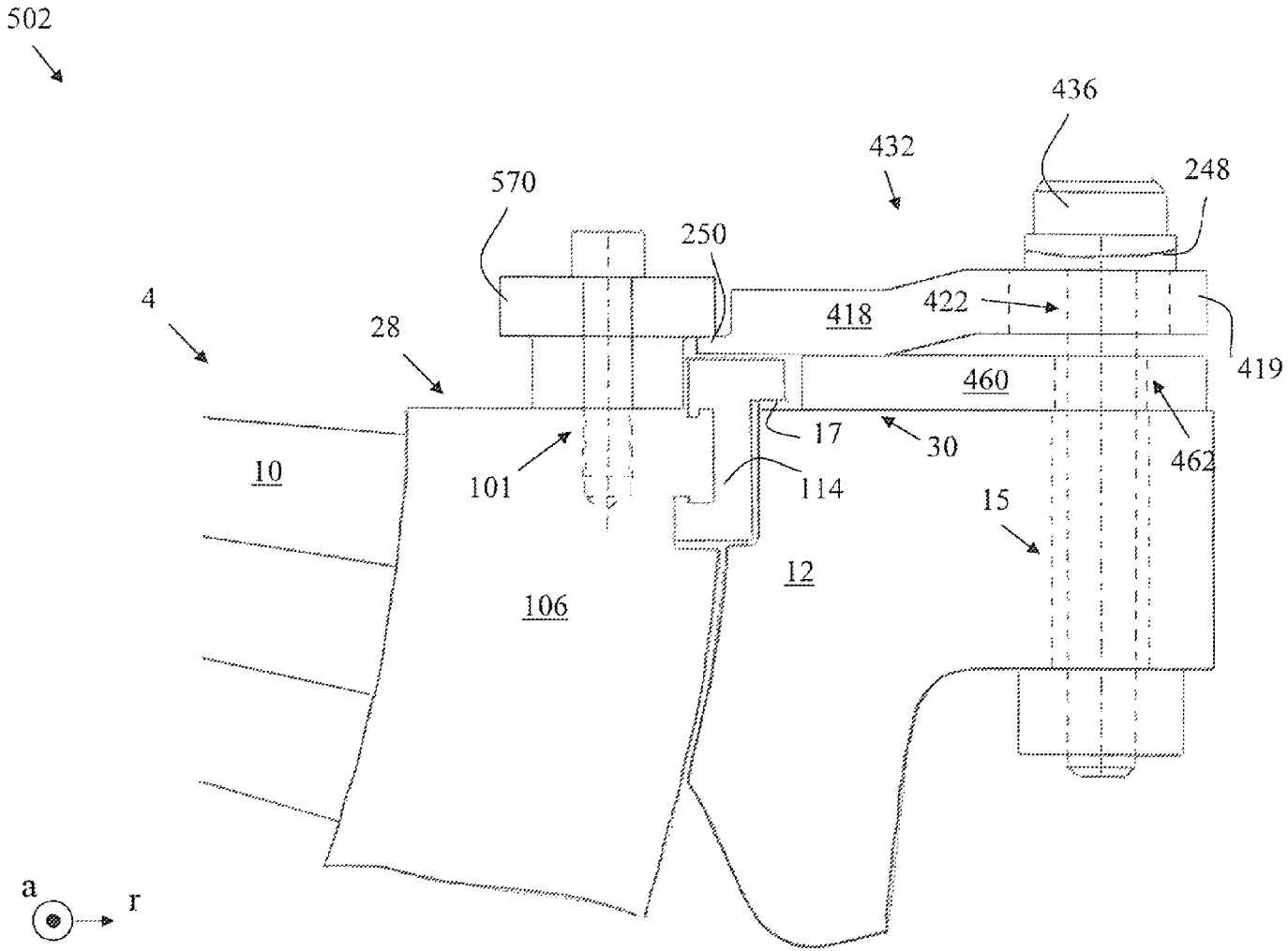
FIG. 6 shows a schematic cut-away view of a steam turbine nozzle assembly including an alignment member according to embodiments of the invention.

FIG. 6 shows a shows a cut-away view of a steam turbine nozzle assembly (or, assembly) 502 according to another embodiment of the invention. This assembly 502 is substantially similar to the assembly 402 of FIG. 5, however, assembly 502 utilizes a pry block 570 to actuate movement of the lower diaphragm segment 106 relative to the casing segment 12. That is, pivoting of the alignment lever member 418 causes the flange 250 to apply an upward force on the pry block 570, which is secured to the outer casing 106 via the bolt 101. This embodiment may be used to align the upper surfaces (28, 30) when the upper diaphragm segment 254 (not shown) is not in place above the lower diaphragm segment 106 (as shown in FIG. 5).

Figure 7:
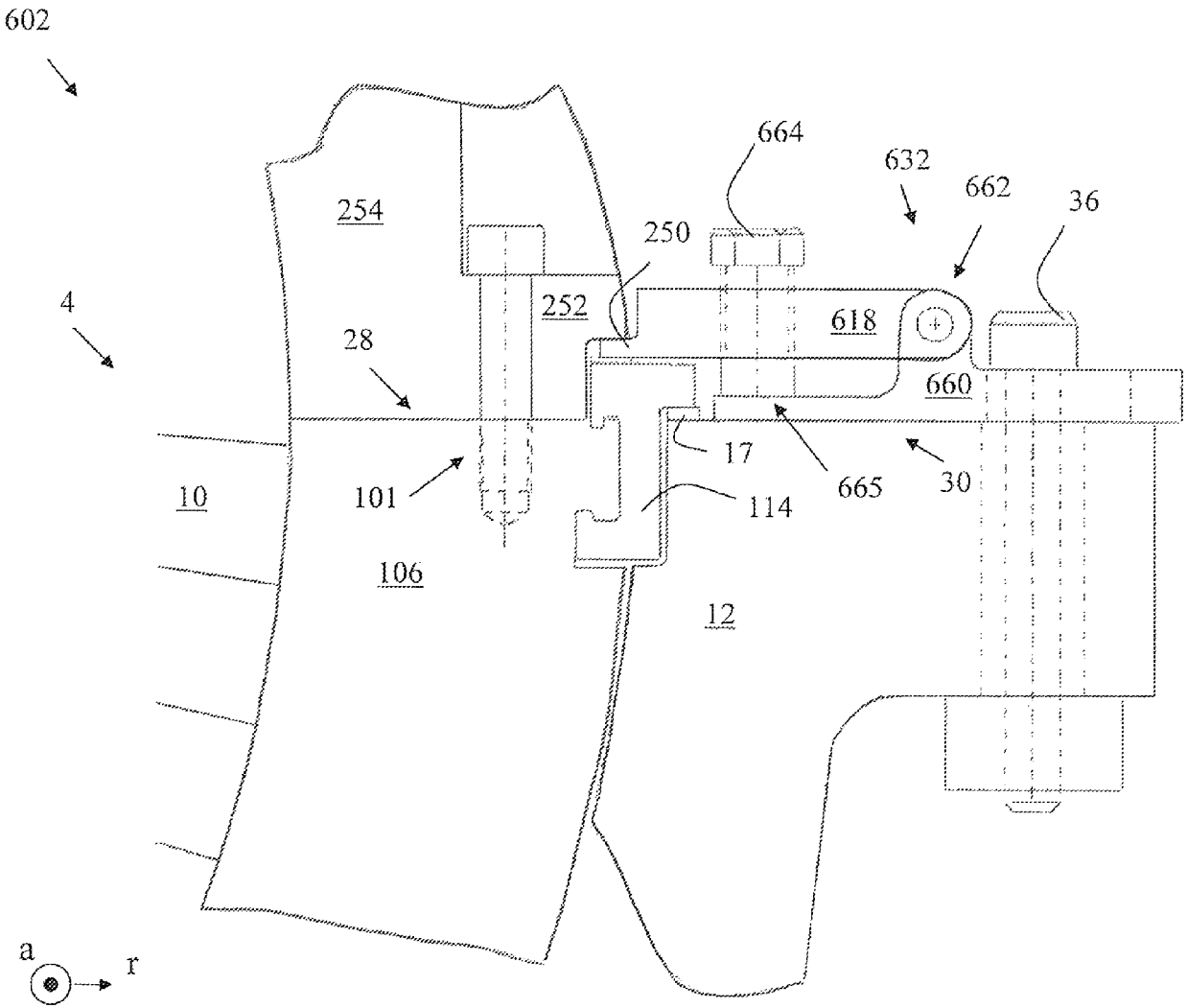
FIG. 7 shows a schematic cut-away view of a steam turbine nozzle assembly including an alignment member according to embodiments of the invention.

FIG. 7 shows a shows a cut-away view of a steam turbine nozzle assembly (or, assembly) 602 according to another embodiment of the invention. In this embodiment, an alignment apparatus 632 is shown including an alignment lever member 618 pivotably attached to a base member 660. The base member 660 can be affixed to the casing segment 12 via a conventional bolt 36 (as shown and described herein with reference to other embodiments). The base member 660 can include a pivot point 662 about which the alignment lever member 618 may pivot. In some cases the alignment lever member 618 can include an aperture for receiving a pin, bolt, or other fixed segment of the base member 660. The alignment lever member 618 can pivot about this aperture while remaining affixed to the base member 660 via the pin, bolt or other fixed segment. As shown, the alignment lever member 618 can include a flange 250 extending therefrom, which can engage a portion 252 of the upper diaphragm segment 254. In this embodiment, the alignment apparatus 632 can include an adjustment member (e.g., an adjustment screw) 664 having a substantially spherical end 665. The adjustment screw 664 is configured to contact a surface of the base member 660, and during actuation, rotate about its axis, thereby causing the body portion of the alignment lever member 618 to move along the threads of the adjustment screw 664. This causes the alignment lever member 618 to pivot about the pivot point 662, either toward or away from the base member 660. Movement of the alignment lever member 618 causes movement of the flange 250, thereby modifying the position of the upper surface 28 of the outer casing 106 relative to the upper surface of the casing segment 12.

It is understood that the embodiments shown and described with reference to FIGS. 1-7 allow for alignment of the upper surfaces of a diaphragm segment and adjacent casing segment in less time (and with less cost/effort) as compared with conventional approaches. Once these surfaces are aligned, a technician may then perform measurement of different spacings, height differences, etc. to determine how the thickness of one or more shims should be modified to maintain alignment. That is, the alignment members shown and described herein can be used to align the upper surfaces of a diaphragm and casing segment in a turbine system, allowing for measurement of dimensions of interest in that turbine system. These dimensions of interest can be used to then modify the size/shape of one or more shims used to support portions of the diaphragm or casing (and, similarly, the support bars used in coupling the diaphragm and casing). The size/shape modifications of the shims can be determined while the diaphragm and casing are aligned, thereby eliminating the need to iteratively test new shim sizes/shapes.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An alignment member for a turbine diaphragm segment, the alignment member configured to span radially across a portion of the turbine diaphragm segment and an adjacent turbine casing segment, the alignment member comprising:

a main body having a first aperture for aligning with a first corresponding aperture in one of the turbine diaphragm segment or the turbine casing segment, wherein the main body aligns with the first corresponding aperture at a horizontal joint surface of the one of the turbine diaphragm segment or the turbine casing segment; and a flange extending from the main body, the flange including a second aperture for aligning with a portion of the other of the turbine diaphragm segment or the turbine casing segment, the alignment member for adjusting a position of the turbine diaphragm segment relative to the adjacent turbine casing segment.

2. The alignment member of claim 1, wherein a portion of the main body is configured to align flush with a portion of the turbine diaphragm segment proximate the first corresponding aperture at the horizontal joint surface.

3. The alignment member of claim 2, wherein the flange is configured to align spaced apart from a portion of the other of the turbine diaphragm segment or the turbine casing segment.

4. The alignment member of claim 1, wherein a portion of the alignment member proximate the first aperture is configured to align separated from a portion of the turbine diaphragm segment proximate the first corresponding aperture.

5. The alignment member of claim 4, wherein a portion of the alignment member proximate the second aperture is configured to align flush with a portion of the casing segment.

6. The alignment member of claim 1, wherein a surface of the flange is configured to align flush with one of the horizontal joint surface of the turbine diaphragm segment or the turbine casing segment.

7. The alignment member of claim 1, wherein the first corresponding aperture extends downward from the horizontal joint surface into the one of the turbine diaphragm segment or the turbine casing segment.

8. An alignment apparatus for a turbine diaphragm segment, the alignment apparatus comprising:

an alignment member configured to span radially across a portion of the turbine diaphragm segment and an adjacent turbine casing segment, the alignment member including:

a main body having a first aperture for aligning with a first corresponding aperture in the turbine diaphragm segment, wherein the main body aligns with the first corresponding aperture at a horizontal joint surface of the turbine diaphragm segment; and a flange extending from the main body, the flange including a second aperture for aligning with a portion of the turbine casing segment, the alignment member for adjusting a position of the turbine diaphragm segment relative to the adjacent turbine casing segment.

9. The alignment apparatus of claim 8, further comprising a first vertical alignment member operably connected with the first aperture.

10. The alignment apparatus of claim 9, further comprising a second vertical alignment member operably connected with the second aperture.

11. The alignment apparatus of claim 8, wherein the first corresponding aperture extends downward from the horizontal joint surface into the turbine diaphragm segment.

12. An alignment apparatus for a turbine diaphragm segment, the alignment apparatus comprising:

an alignment lever member configured to span radially between the turbine diaphragm segment and a turbine casing segment, the alignment lever member operably affixed to a portion of the turbine casing segment and including:

a main body; and a flange extending radially inward from the main body, the flange for engaging a portion of an upper diaphragm segment, the alignment lever member for modifying a position of the turbine diaphragm segment relative to the turbine casing segment; and a base member pivotably connected to the alignment lever member, the alignment lever member configured to pivot about a portion of the base member.

13. The alignment apparatus of claim 12, wherein the base member includes a pivot member and the alignment lever member is configured to pivot about the pivot member.

14. The alignment apparatus of claim 12, wherein the base member is further configured to fixedly connect to the turbine casing segment.

15. The alignment apparatus of claim 12, wherein the base member is further configured to fixedly connect to the main body of the alignment lever member.

16. The alignment apparatus of claim 12, wherein the main body is configured to pivotably connect with the base member.

17. The alignment apparatus of claim 12, wherein the flange remains substantially free when the main body is fixedly connected with the base member.

18. The alignment apparatus of claim 12, further comprising an adjustment screw for adjusting a position of the alignment lever member.

19. The alignment apparatus of claim 12, wherein the main body includes an aperture configured to align with an aperture of the turbine casing segment.

20. The alignment apparatus of claim 19, further comprising an attachment member for connecting the main body with the turbine casing segment at the aperture of the main body and the aperture of the turbine casing segment.

* * * * *